US009216446B2

(12) United States Patent
Karube

(10) Patent No.: US 9,216,446 B2
(45) Date of Patent: Dec. 22, 2015

(54) DESCALING NOZZLE FOR REMOVING SCALE FROM STEEL SHEET, DESCALING APPARATUS FOR REMOVING SCALE FROM STEEL SHEET, AND DESCALING METHOD FOR REMOVING SCALE FROM STEEL SHEET

(75) Inventor: Kenta Karube, Fukuyama (JP)

(73) Assignee: JFE STEEL CORPORATION, Tokyo (JP)

( * ) Notice: Subject to any disclaimer, the term of this patent is extended or adjusted under 35 U.S.C. 154(b) by 237 days.

(21) Appl. No.: 13/977,324

(22) PCT Filed: Dec. 13, 2011

(86) PCT No.: PCT/JP2011/079272

§ 371 (c)(1),
(2), (4) Date: Jun. 28, 2013

(87) PCT Pub. No.: WO2012/101932

PCT Pub. Date: Aug. 2, 2012

(65) Prior Publication Data

US 2013/0298626 A1 Nov. 14, 2013

(30) Foreign Application Priority Data

Jan. 26, 2011 (JP) ..... 2011-013923
Dec. 5, 2011 (JP) ..... 2011-266196

(51) Int. Cl.

| | |
|---|---|
| ***B21B 45/04*** | (2006.01) |
| ***B05B 1/04*** | (2006.01) |
| ***B05B 1/14*** | (2006.01) |
| ***B05B 7/04*** | (2006.01) |
| *B21B 45/08* | (2006.01) |

(52) U.S. Cl.

CPC ..... *B21B 45/04* (2013.01); *B05B 1/042* (2013.01); *B05B 1/14* (2013.01); *B05B 7/0408* (2013.01); *B21B 45/08* (2013.01)

(58) Field of Classification Search

CPC ..... B21B 45/04; B21B 45/08; B05B 1/042; B05B 1/14; B05B 7/04; B05B 7/0408; B05B 7/06; B05B 7/08

USPC ..... 72/39; 29/81.08

See application file for complete search history.

(56) References Cited

U.S. PATENT DOCUMENTS 2,783,093 A * 2/1957 Hesky ..... 239/472
4,185,706 A * 1/1980 Baker et al. ..... 175/340

(Continued)

FOREIGN PATENT DOCUMENTS

JP B2-58-1167 1/1983
JP B2-60-15684 4/1985

(Continued)

OTHER PUBLICATIONS

International Search Report issued in International Patent Application No. PCT/JP2011/079272 dated Jan. 17, 2012.

*Primary Examiner* — Edward Tolan
(74) *Attorney, Agent, or Firm* — Oliff PLC

(57) ABSTRACT

Provided is a descaling nozzle that can efficiently remove scale from a steel sheet. A discharge section at an end of a descaling nozzle includes a discharge hole (main flow orifice) and a branch hole (branch flow orifice) that are connected to a large diameter portion that forms a cylindrical channel. The branch flow orifice discharges a part of water flow in the large diameter portion so that cavitation occurs at a boundary between the part of water flow discharged from the branch flow orifice and water flow that is discharged from the discharge hole.

17 Claims, 7 Drawing Sheets

(56) References Cited

U.S. PATENT DOCUMENTS

| | | | | |
|---|---|---|---|---|
| 7,077,724 | B1 * | 7/2006 | Voges | 451/38 |
| 8,297,540 | B1 * | 10/2012 | Vijay | 239/589 |

FOREIGN PATENT DOCUMENTS

| | | | | |
|---|---|---|---|---|
| JP | A-1-249214 | | 10/1989 | |
| JP | 8-257998 | A * | 10/1996 | B26F 3/00 |
| JP | A-2000-167497 | | 6/2000 | |
| JP | A-2003-62492 | | 3/2003 | |
| JP | A-2005-34908 | | 2/2005 | |
| JP | A-2006-341318 | | 12/2006 | |
| JP | A-2007-260550 | | 10/2007 | |
| JP | B2-2-4084295 | | 4/2008 | |
| JP | A-2011-131275 | | 7/2011 | |
| SU | 1286308 | A * | 2/1985 | B08B 9/04 |
| WO | 03/091096 | A1 * | 11/2003 | B08B 3/02 |
| WO | WO 2004/058427 | A1 | 7/2004 | |
| WO | 2006/043911 | A1 * | 4/2006 | B08B 3/02 |

* cited by examiner

DESCALING NOZZLE FOR REMOVING SCALE FROM STEEL SHEET, DESCALING APPARATUS FOR REMOVING SCALE FROM STEEL SHEET, AND DESCALING METHOD FOR REMOVING SCALE FROM STEEL SHEET

TECHNICAL FIELD

The present invention relates to a descaling nozzle for removing scale from a surface of a steel sheet, a descaling apparatus for removing scale from a steel sheet, and a descaling method for removing scale from a steel sheet.

BACKGROUND ART

In a rolling line for rolling a steel material, a steel material is charged into a heating furnace in an oxidizing atmosphere, is heated for several hours at a temperature generally in the range of 1100 to 1300° C., and subsequently is hot rolled. When hot rolling is performed, primary scale is generated during heating and secondary scale is generated after discharging from the heating furnace. If rolling of a steel material is performed without removing such scale, the scale becomes buried in the surface of the steel sheet, which is a product, and causes scale defects. Scale defects greatly influence the product quality, because scale defects significantly impair the surface condition of a steel sheet and become the initiation of cracks during bending work.

To solve the problem described above, the following methods have been proposed: (1) a method of applying an antioxidant agent to a surface of a steel material (see, for example, Patent Literature 1), (2) a method of heating a steel material at a temperature equal to or lower than the melting point of fayalite (about 1170° C.) (see, for example, Patent Literature 2), (3) a method of performing rolling in a completely oxygen-free state (see, for example, Patent Literature 3), (4) a method of making the temperature before rolling and temperature during rolling be high (about 1000° C. or higher), and (5) a method of completely removing generated scale (see, for example, Patent Literature 4).

However, with the method (1), not only it is necessary to additionally perform a troublesome application operation, but also the production cost is increased due to the cost of a processing agent. With the method (2), a load applied to the rolling mill increases, because a steel material is heated at a low temperature. Moreover, depending on the steel grade, the method may not be used in consideration of ensuring material characteristics. The method (3) is not realistic, because it requires high equipment cost. With the method (4), fuel consumption rate increases and scale loss increases, because discharging from the heating furnace is performed at a high temperature.

As a solution to the problem, the method (5) of completely removing generated scale, which is a method of performing so-called "descaling", is effective. A descaling nozzle used for a descaling apparatus for performing descaling usually sprays high pressure water onto a surface of a steel sheet and peels off and removes scale from the steel sheet using the impact force of the sprayed water.

CITATION LIST

Patent Literature

PTL 1: Japanese Unexamined Patent Application Publication No. 1-249214

PTL 2: Japanese Examined Patent Application Publication No. 58-1167

PTL 3: Japanese Examined Patent Application Publication No. 60-15684

PTL 4: Japanese Patent No. 4084295

SUMMARY OF INVENTION

Technical Problem

Regarding the method (5), Patent Literature 4 describes a technology for improving the internal structure of a descaling nozzle. The descaling nozzle includes an orifice (discharge hole) at an end of the nozzle, a taper portion extending so as to be tapered with a taper angle of 30 to 80° from the orifice, and a large diameter portion connected to the taper portion. The ratio (D1/D2) of the inside diameter D1 of the large diameter portion to the minor axis D2 of the orifice is greater than or equal to 3.

However, the technology described in Patent Literature 4 has a limitation that it cannot significantly improve the descaling performance, because it is a technology for optimizing the internal structure of existing descaling nozzles.

Solution to Problem

The inventors addressed such a problem and carried out examinations in order to provide a descaling nozzle for removing scale from a steel sheet, a descaling apparatus for removing scale from a steel sheet, and a descaling method for removing scale from a steel sheet, with which scale can be more efficiently removed. The inventors focused on cavitation that occurs on a surface of scale on a steel sheet when a water flow jet that is discharged from a descaling nozzle forms a droplet (see FIG. 1). The inventors examined a phenomenon that, under certain conditions, a pressure that is generated when a bubble that has been generated due to cavitation collapses becomes significantly larger than an impact force that is generated when the droplet collides with the surface of the scale as illustrated in FIG. 2. The inventors considered that the descaling performance can be improved by actively causing cavitation in the water flow jet. Then, the inventors made prototypes of various nozzles and carried out further study. As a result, the inventors found that the descaling performance can be significantly improved by forming a nozzle so as to have a predetermined shape; and thereby invented an improved descaling nozzle, an improved descaling apparatus for removing scale from a steel sheet, and an improved descaling method for removing scale from a steel sheet.

To solve the problem described above, according to an aspect of the present invention, there is provided a descaling nozzle for removing scale from a steel sheet by spraying water onto a surface of the steel sheet and using impact of the sprayed water. A discharge section at an end of the nozzle includes a main flow orifice and a branch flow orifice that are connected to a large diameter portion that forms a cylindrical channel. The branch flow orifice discharges a part of water flow in the large diameter portion so that cavitation occurs at a boundary between the part of water flow discharged from the branch orifice and water flow that is discharged from the main flow orifice.

Existing descaling nozzles generate a droplet stream by spraying a continuous water flow (main flow) jet from a single orifice. However, with the descaling nozzle for removing scale from a steel sheet according to the aspect of the present invention, a discharge section at an end of the nozzle includes a main flow orifice and a branch flow orifice that are connected to a large diameter portion that forms a cylindrical channel. Moreover, the branch flow orifice discharges a part of water flow in the large diameter portion so that cavitation occurs at a boundary between the part of water flow discharged from the branch orifice and water flow that is discharged from the main flow orifice. Therefore, a part of water flow in the nozzle can be discharged from a branch flow orifice through a branch channel, so that the nozzle can cause cavitation at the boundary between the part of water flow discharged from the branch flow orifice and a water flow (main flow) jet that is discharged from the main flow orifice of the nozzle. As a result, the descaling performance can be significantly improved as compared with existing nozzles.

In the descaling nozzle for removing scale from a steel sheet according to the aspect of the present invention, it is preferable that the branch flow orifice discharge water flow (through a branch channel) so that the water flow surrounds an outer periphery of a water flow (main flow) jet that is discharged from the main flow orifice. Thus, the nozzle can appropriately cause cavitation at the boundary between the part of water flow discharged from the branch orifice and a water flow (main flow) jet that is discharged from the main flow orifice. As a result, the descaling performance can be significantly improved as compared with existing nozzles.

In the descaling nozzle for removing scale from a steel sheet according to the aspect of the present invention, it is preferable that the ratio of an amount of water flow in the large diameter portion that is introduced into the branch flow orifice to an amount of entire water flow in the large diameter portion be greater than 0% and less than or equal to 50%.

To solve the problem described above, according to an aspect of the present invention, there is provided a descaling apparatus for removing scale from a steel sheet. The descaling apparatus includes a plurality of descaling nozzles disposed above and below the steel sheet that is a material to be rolled in a rolling process. The descaling apparatus removes scale from a surface of the material to be rolled by spraying high pressure water from the descaling nozzles onto the surface of the material to be rolled. Each of the descaling nozzles is the descaling nozzle for removing scale from a steel sheet according to any one of the embodiments of the aspect of the present invention described above.

With the descaling apparatus for removing scale from a steel sheet according to the aspect of the present invention, because each of the descaling nozzles has the effect and the advantage of the descaling nozzle according to one of the embodiments of the aspect of the present invention described above, scale can be efficiently removed through the aforementioned mechanism.

To solve the problem described above, according to an aspect of the present invention there is provided a method for removing scale from a steel sheet that is a material to be rolled in a rolling process by spraying high pressure water from a descaling nozzle onto a surface of the material to be rolled. The descaling nozzle for removing scale from a steel sheet according to any one of the embodiments of the aspect of the present invention described above is used as the descaling nozzle. The descaling nozzle is disposed at each of a plurality of positions above and below the rolling material in the rolling process. High pressure water is sprayed from the descaling nozzles onto the surface of the material to be rolled to remove scale from the surface of the material to be rolled.

With the descaling method for removing scale from a steel sheet according to the aspect of the present invention, because the descaling nozzle used in the method has the effect and the advantage of the descaling nozzle according to one of the embodiments of the aspect of the present invention described above, scale can be efficiently removed through the aforementioned mechanism.

Advantageous Effects of Invention

As described above, with the present invention, scale can be efficiently removed from a surface of a material to be rolled.

DESCRIPTION OF EMBODIMENTS

Hereinafter, an embodiment of a descaling apparatus for removing scale from a steel sheet including a descaling nozzle according to an aspect of the present invention will be described.

Figure 1:
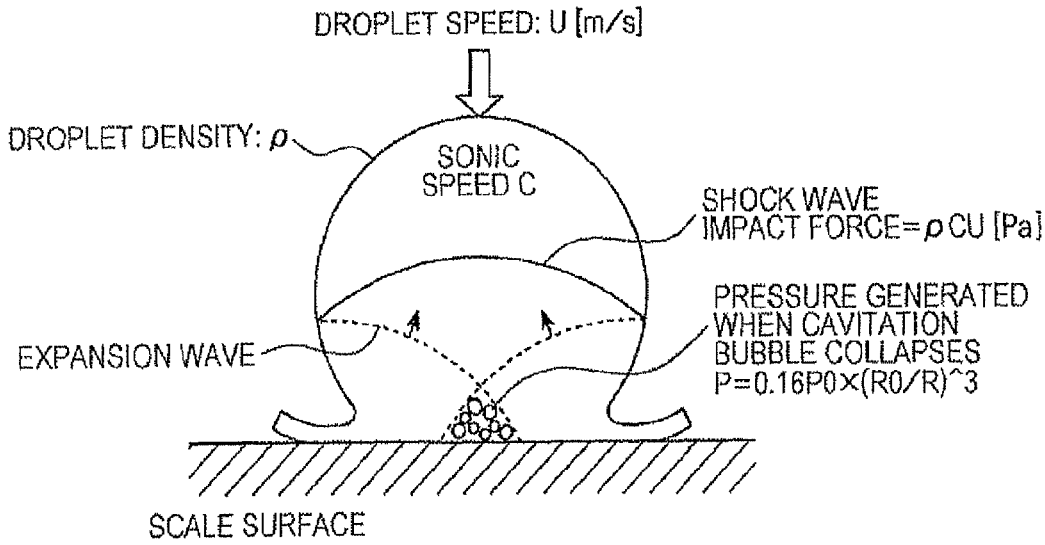
FIG. 1 is a schematic view illustrating cavitation that occurs when a water flow jet that is discharged from a descaling nozzle becomes a droplet and the droplet collides with a surface of scale on a steel sheet.
Figure 2:
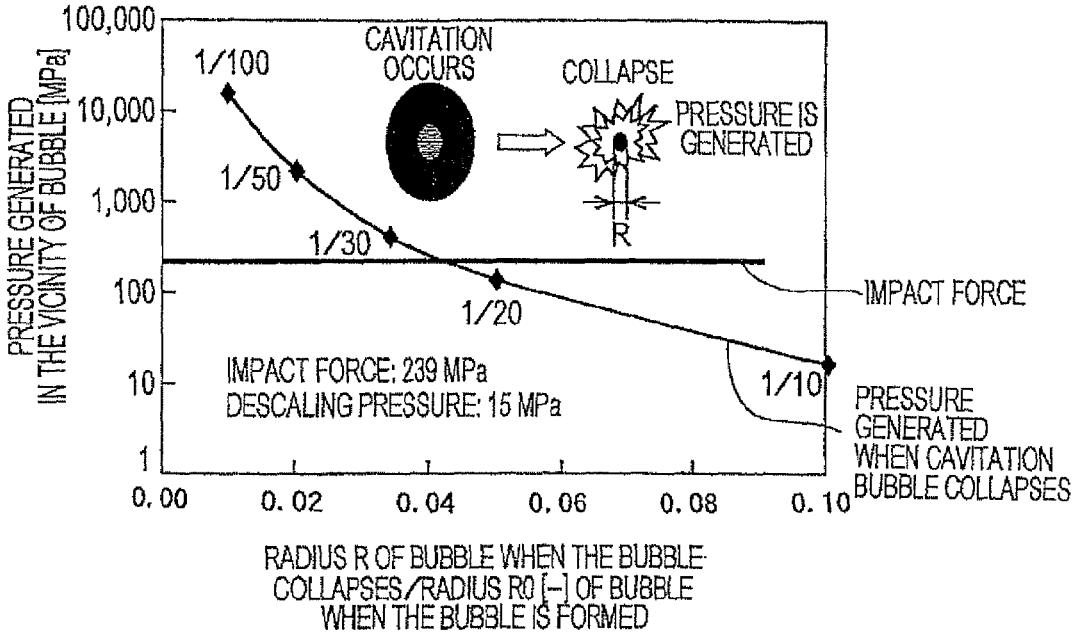
FIG. 2 is a schematic diagram illustrating a process in which a bubble is generated due to cavitation shown in FIG. 1 and a pressure is generated when the bubble collapses and the relationship between (the radius of a bubble when the bubble collapses)/(the radius of the bubble when the bubble is generated) and the pressure generated in the vicinity of the bubble.
Figure 3:
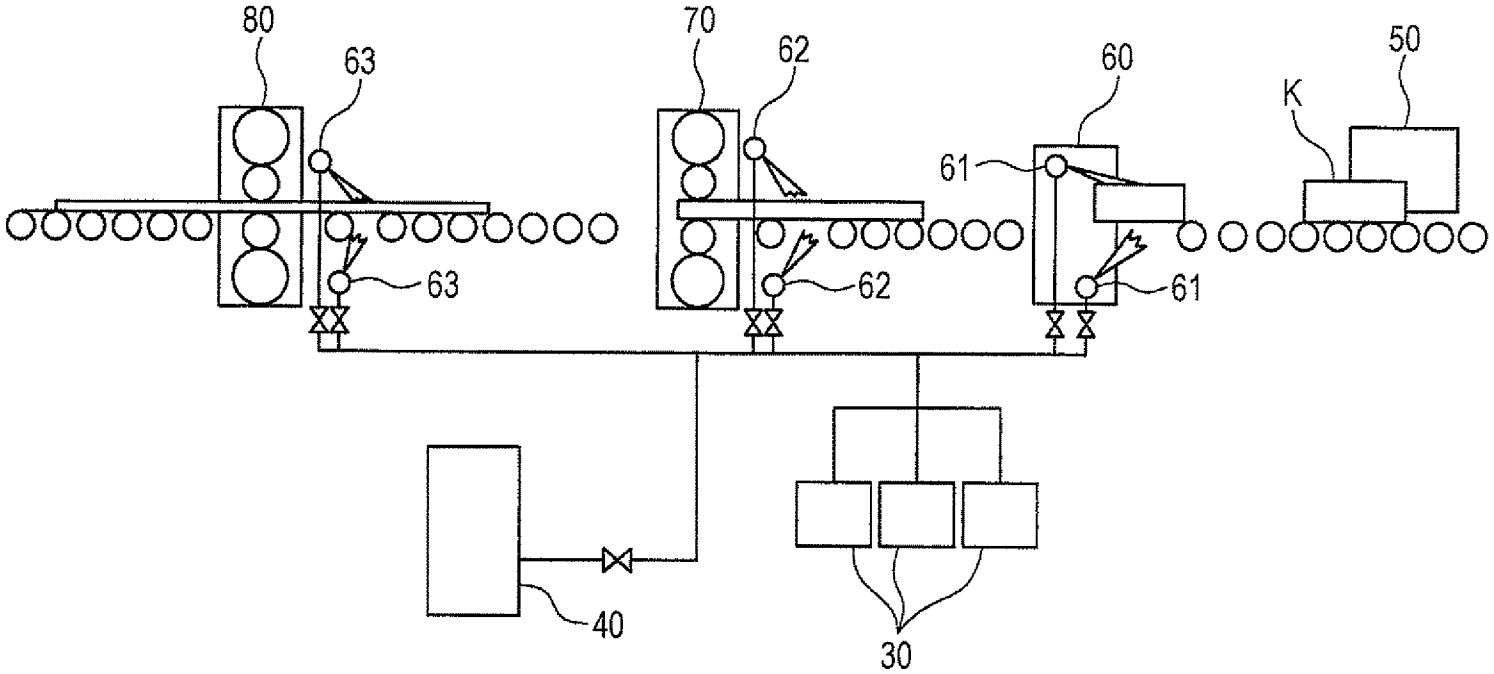
FIG. 3 is a schematic view illustrating an example of a rolling line including a descaling apparatus for removing scale from a steel sheet according to the present invention.

As illustrated in FIG. 3, a rolling line for rolling a steel sheet includes a heating furnace 50 that heats a material to be rolled (steel slab) K, a heating furnace delivery side descaler 60 that is disposed on the delivery side (HSB) of the heating furnace 50 and that removes scale from the material to be rolled K that has been discharged from the heating furnace 50, a rough rolling mill 70 that subsequently performs rough rolling, and a finish rolling mill 80 that subsequently performs finish rolling.

The descaling apparatus according to the present invention is disposed in each section of the rolling line. That is, in the heating furnace delivery side descaler 60, descaling nozzle attachment adapters 61 for attaching heating furnace delivery side descaling nozzles are disposed above and below the to be rolled material K. Likewise, on the rough rolling entry side (RSB) of the rough rolling mill 70, descaling nozzle attachment adapters 62 are disposed above and below the material to be rolled K. On the finish rolling entry side (FSB) of the finish rolling mill 80, descaling nozzle attachment adapters 63 are disposed above and below the material to be rolled K. A descaling nozzle 1 described below (hereinafter, simply referred to as a "nozzle") is attached to each of the descaling, nozzle attachment adapters 61, 62, and 63. The descaling nozzles 1 attached to the descaling nozzle attachment adapters 61, 62, and 63 are connected to pumps 30 and an accumulator 40 through pipes, and can spray high pressure water onto a surface of the material to be rolled K. With this apparatus, the pressure and the amount of sprayed high pressure water can be constantly and stably controlled by using the pumps 30 and the accumulator 40.

Figure 4:
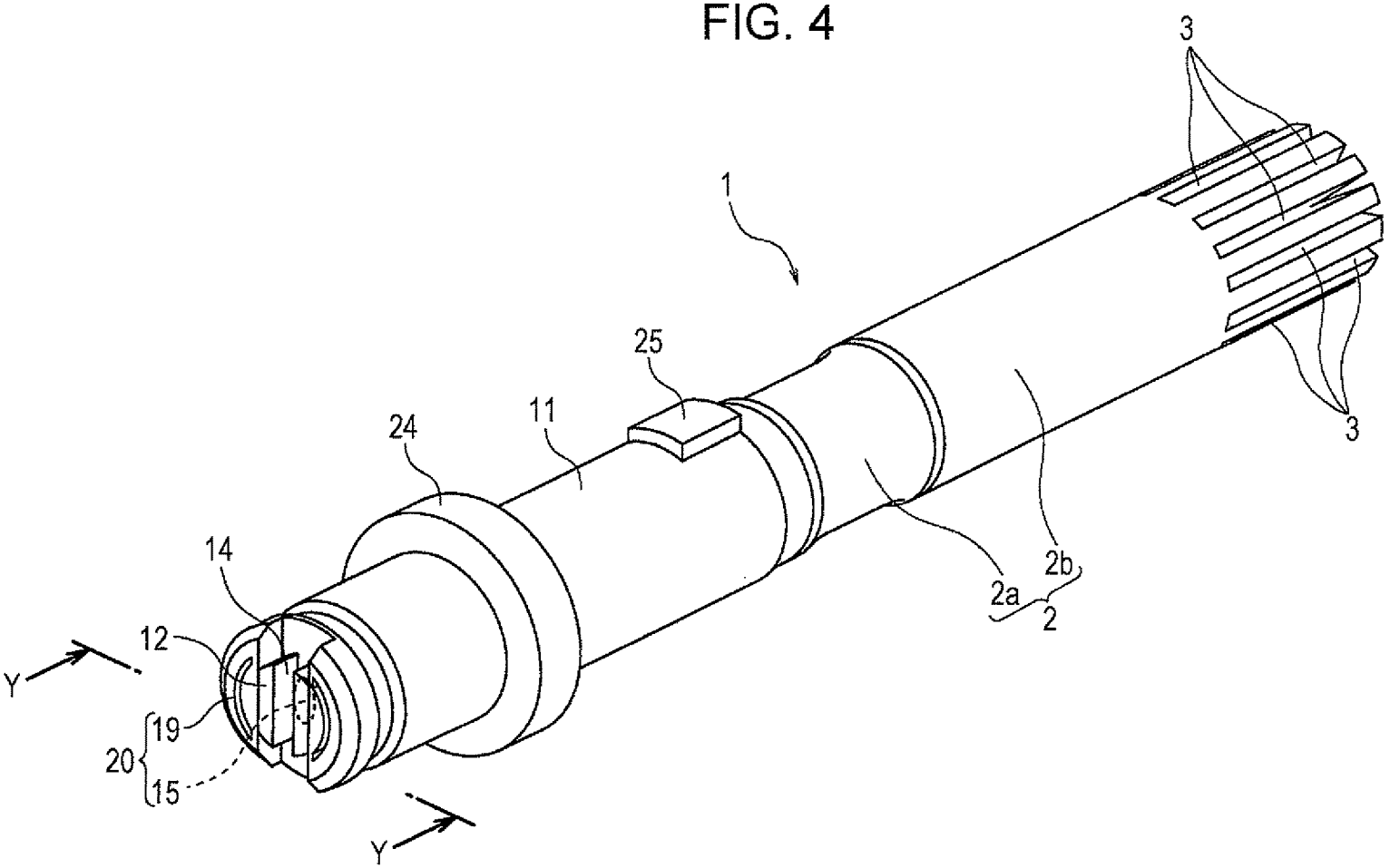
FIG. 4 is a schematic perspective view illustrating an example of a descaling nozzle according to the present invention.

Next, the nozzle 1 will be described in detail. FIG. 4 is a schematic perspective view of the nozzle 1, FIG. 5 is a schematic sectional view taken along a plane of line Y-Y of FIG. 4 in the axial direction, and FIG. 6 is a schematic front view of a discharge section at an end of the nozzle of FIG. 4.

Figure 5:
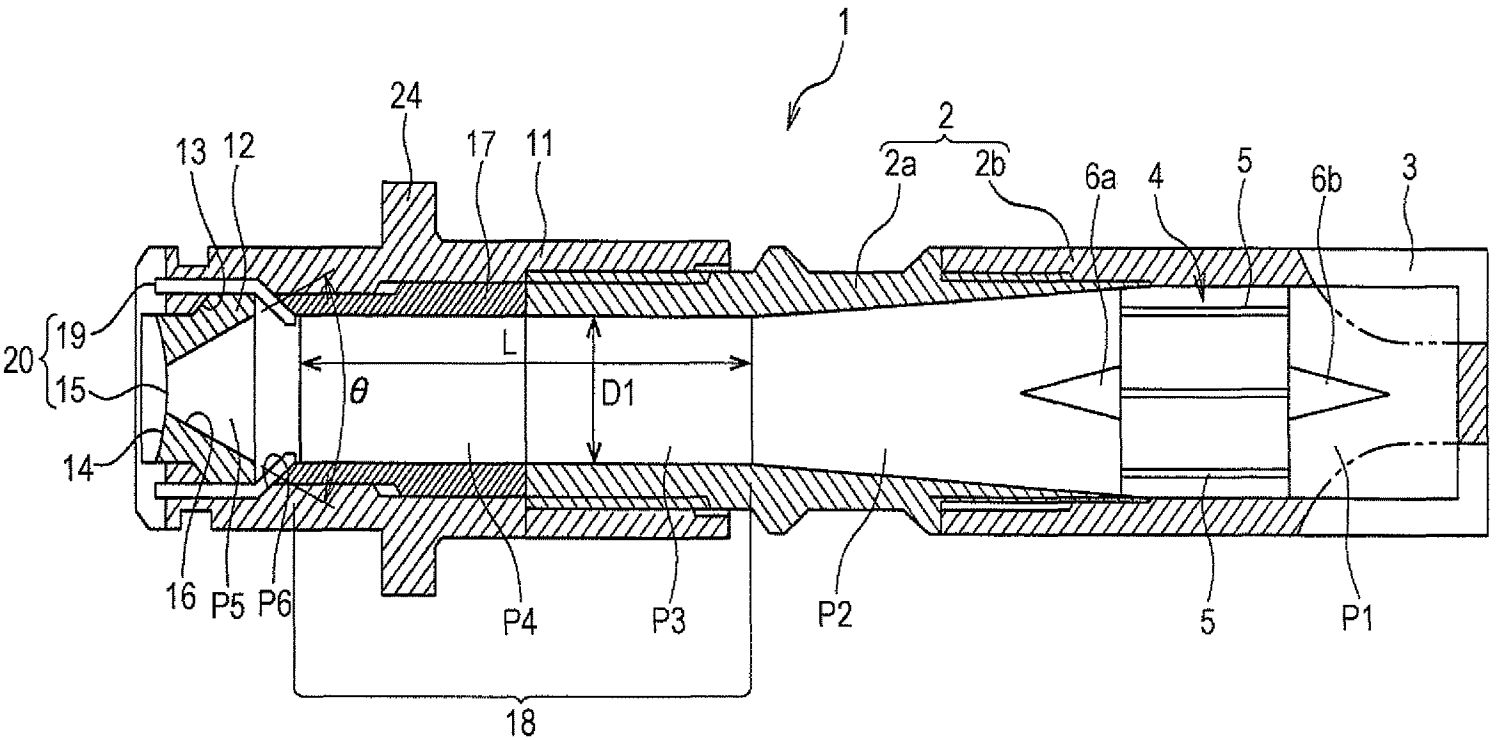
FIG. 5 is a schematic sectional view taken along a plane of line Y-Y of FIG. 4 in the axial direction.
Figure 6:
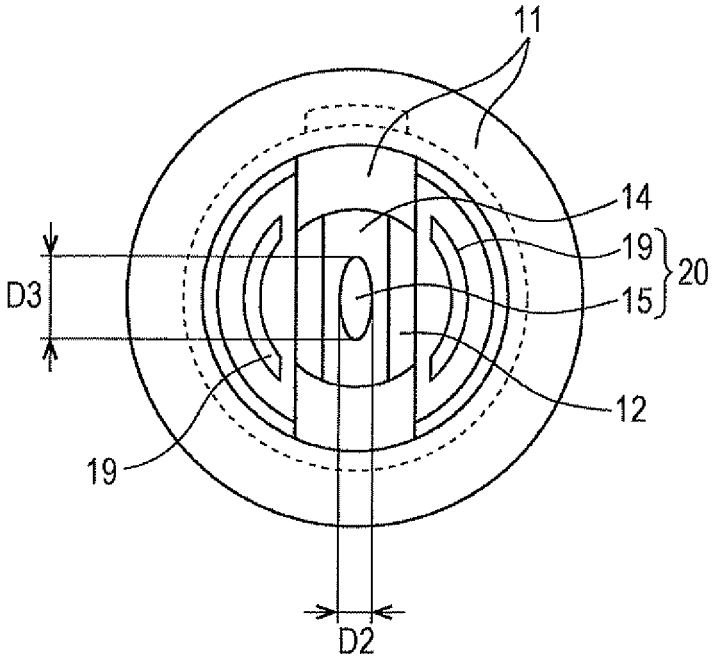
FIG. 6 is a schematic front view of a discharge section of the nozzle of FIG. 4.

As illustrated in FIGS. 4 to 6, the nozzle 1 includes a casing 2, a nozzle case 11, and a nozzle tip 12. These members form a channel (or a nozzle hole) extending in the axial direction of the nozzle 1.

The casing 2 is substantially cylindrical and has a channel (or a nozzle hole) formed therein. Water can flow into the channel from one end of the casing 2 on the upstream side of the nozzle 1. The nozzle case 11 is attached to the other end of the casing 2. The nozzle case 11 is substantially cylindrical, and the nozzle tip 12 is attached to an end portion of the nozzle 1. The nozzle tip 12, from which water is sprayed, is made of a cemented carbide.

In this example, the casing 2 includes a first casing 2*a*, which can be fixed to the nozzle case 11 with a screw thread, and a second casing 2*b*, which can be fixed to the first casing 2*a* with a screw thread.

In a peripheral surface and an end surface of the upstream end portion of the second casing 2*b*, a plurality of slits (or inlets) 3 extending in the axial direction are arranged in the circumferential direction at a predetermined pitch. The slits 3 serve as a filter that allows entry of water while suppressing entry of impurities. A flow regulation unit (or a flow regulator or a stabilizer) 4 is disposed in a channel in the second casing 2*b*.

The flow regulation unit 4, which guides water from the slits 3 to nozzle holes, includes a plurality of flow regulation plates (flow regulation blades) 5 extending radially from a core member, and a pair of pointed conical portions (respectively tapered upstream and downstream) 6*a* and 6*b*, which are formed on the upstream side and on the downstream side of the core member so as to be coaxial with each other and so that the end portions thereof respectively point upstream and downstream. The casing 2, which serves as a filter and includes the flow regulation unit, may be called a filter unit or a flow regulation casing.

The flow regulation plates 5 of the flow regulation unit 4 are in contact with an inner wall of the second casing 2*b*. Movement of the flow regulation unit 4 in the downstream direction is restricted by fixing means (for example, engaging, welding, or adhesion).

The channel in the casing 2 includes a cylindrical channel P1, an inclined channel (annular inclined channel) P2, and a cylindrical channel P3. The cylindrical channel P1 extends from an upstream end (inlet) of the second casing 2*b* to a downstream end of the flow regulation unit 4 and has a substantially constant inside diameter (which is the same as the inside diameter of the upstream end portion of the casing 2*b*). The inclined channel P2 extends downstream from the downstream end of the flow regulation unit 4 to a middle portion of the first casing 2*a* and tapers with a gentle inclination. The cylindrical channel P3 extends downstream from a downstream end of the inclined channel and has a substantially constant inside diameter (which is the same as the inside diameter of a downstream end portion of the inclined channel P2). In this example, the taper angle of an inclined wall (taper portion) of the inclined channel (annular inclined channel) P2 is, for example, in the range of 5 to 10°.

The nozzle tip 12, which is made of a cemented carbide, and a bushing (or an annular side wall) 17 are attached to the inside of the nozzle case 11 so as to be arranged upstream from the end of the nozzle 1. In the bushing 17, a channel having an inside diameter substantially the same as that of the downstream end of the first casing 2*a* is formed. An engagement stepped portion 13 prevents the nozzle tip 12 from being extracted toward the end portion.

In the nozzle tip 12, which corresponds to a discharge section at an end of the nozzle 1, includes a large diameter portion 18 that forms a cylindrical channel, a taper portion 16 that is continuous with the large diameter portion 18, and an elliptical discharge hole 15 that is continuous with the outlet side of the taper portion 16. In an end surface of the nozzle tip 12, a curved groove 14 having a U-shaped cross section is formed so as to extend in the radial direction. As illustrated in FIG. 6, in a concavely curved surface of the curved groove 14, a discharge hole 15 having an elliptical shape is formed so as to be continuous with the outlet side. The bottom surface of the curved groove 14 may be a curved bottom surface whose end portions rise from the discharge hole 15, which is the bottommost portion, in an extension direction (or the radial direction).

The nozzle 1 has two branch holes (branch flow orifices) 19 that are disposed between the nozzle tip 12 and the nozzle case 11 and that are connected to the large diameter portion 18, which forms a cylindrical channel. Each of the branch holes 19 has an arc-shape extending along the circumferential direction of the nozzle tip 12 (in this case, the center of the arc is on the axis). Each of the branch holes 19 discharges a part of water flow in the nozzle so that cavitation C occurs at the boundary between the part of water flow discharged from branch hole 19 and water flow that is discharged from the discharge hole 15 in the nozzle tip 12 (see FIG. 9(*a*)). Because the branch holes 19 have arc shapes extending in the circumferential direction of the nozzle tip 12, each of the branch holes 19 discharges water flow so that the water flow surrounds water flow that is discharged from the discharge hole 15.

Thus, a nozzle channel (nozzle hole), which extends in the axial direction of the nozzle 1, includes a conical channel 25, branch channels 26, a cylindrical channel 24, and the cylindrical large-diameter channels (channels extending from the upstream end of the cylindrical channel P4 to the upstream end of the flow regulation unit 4) P3 to P1. The conical channel P5 includes the taper portion (or a conical inclined wall) 16 extending upstream from the discharge hole 15 in the axial direction with linearly increasing diameter. The branch channels P6 are formed between the nozzle tip 12 and the nozzle case 11 and include the branch holes 19. The cylindrical channel P4 is formed by the inner periphery of the bushing 17 and extends upstream from the upstream end of the taper portion 16 in the axial direction with a substantially uniform inside diameter. The cylindrical large-diameter channels P3 to 21 extend from the upstream end of the cylindrical channel P4 with a substantially uniform inside diameter. A large diameter portion 18 includes a channel extending from the upstream end of the taper portion 16 with a substantially uniform inside diameter (in this example, the cylindrical channels 23 and P4, which extend from the upstream end of the taper portion 16 to the downstream end of the gently inclined channel P2)

The discharge hole 15 has an elliptical shape whose ratio of the major axis D3 to the minor axis D2 is in the range of about 1.5 to 1.8. Regarding the relationship between the discharge hole 15 and the large diameter portion 18, in order to reduce the size of the nozzle, the ratio (D1/D2) of the inside diameter D1 of the large diameter portion 18 (the cylindrical channels P3 and P4, or the downstream end of the inclined channel P2 extending downward from the flow regulation unit) to the minor axis D2 of the discharge hole 15 is set in the range of about 4.5 to 6.9. In order to increase the impact force even if sprayed water has a low pressure and/or a low flow rate, the angle (taper angle) θ of the taper portion 16 is set in the range of about 45 to 55°.

An attachment portion such as a flange portion (or flange) 24 for attaching the nozzle 1 to a conduit (not shown) using an adapter (not shown) can be formed at an appropriate position on the nozzle case 11 or the casing 2 (in this example, the nozzle case 2). A positioning protrusion 25 for positioning the nozzle case 11 relative to a conduit may be formed on the nozzle case 11 so that the positioning accuracy can be increased and water can be sprayed in a flat shape or a strip-like shape in a predetermined direction.

Next, the effects and advantages of the descaling apparatus for removing scale from a steel sheet described above, the descaling nozzle 1 attached to the descaling apparatus, and a descaling method for removing scale from a steel sheet using the nozzle 1 will be described.

The nozzle 1 is attached to each of the descaling nozzle attachment adapters 61, 62, and 63 of the descaling apparatus. As described above, the discharge section at an end of the nozzle 1 includes the taper portion 16, which is continuous with the large diameter portion 18 that forms a cylindrical channel, and the discharge hole 15. The discharge hole 15 is continuous with the outlet side of the taper portion 16. Moreover, the branch holes 19 is disposed between the nozzle tip 12 and the nozzle case 11 so as to be connected to the large diameter portion 18, which forms the cylindrical channel. The branch holes 19 discharge a part of water flow in the nozzle so that cavitation occurs at the boundary between the part of water flow discharged from the branch holes 19 and water flow that is discharged from the discharge hole 15 in the nozzle tip 12. Thus, the nozzle can cause cavitation at the boundary between the part of water flow discharged from the branch holes and the water flow (main flow) discharged from the orifice of the nozzle. As a result, the descaling performance can be significantly improved as compared with existing nozzles. Accordingly, with the descaling apparatus, the descaling nozzle 1 attached to the descaling apparatus, and the descaling method for removing scale from a steel sheet using the nozzle 1, performance and efficiency in descaling can be significantly improved.

EXAMPLE

Hereinafter, an example in which the nozzle 1 according to the embodiment was used in a descaling apparatus in an actual rolling line for rolling a material to be rolled K will be described. Steel materials used in the example had a standard width of 1.2 m and a standard thickness of 220 mm on the delivery side of the heating furnace 50, a standard thickness in the range of 220 to 70 mm on the rough rolling entry side (RSB) 62, and a standard thickness in the range of 60 to 40 mm on the finish rolling entry side (FSB) 63. Table 1 below shows the results of a comparative experiment in which comparison with an existing type of nozzle was performed (see FIG. 7). In this example, the ratio of the amount of water flow in the nozzle that is introduced into the branch holes to the amount of entire water flow in the nozzle was adjusted so as to be in the range of 0% or greater to less than or equal to 50% in accordance with the spraying pressure P0 [Pa], the descaling flow rate [1/min], and the spraying distance H[m].

As an evaluation method, a descaling performance evaluation model that had been proposed (see Japanese Patent No. 3129967) was used.

Figure 8:
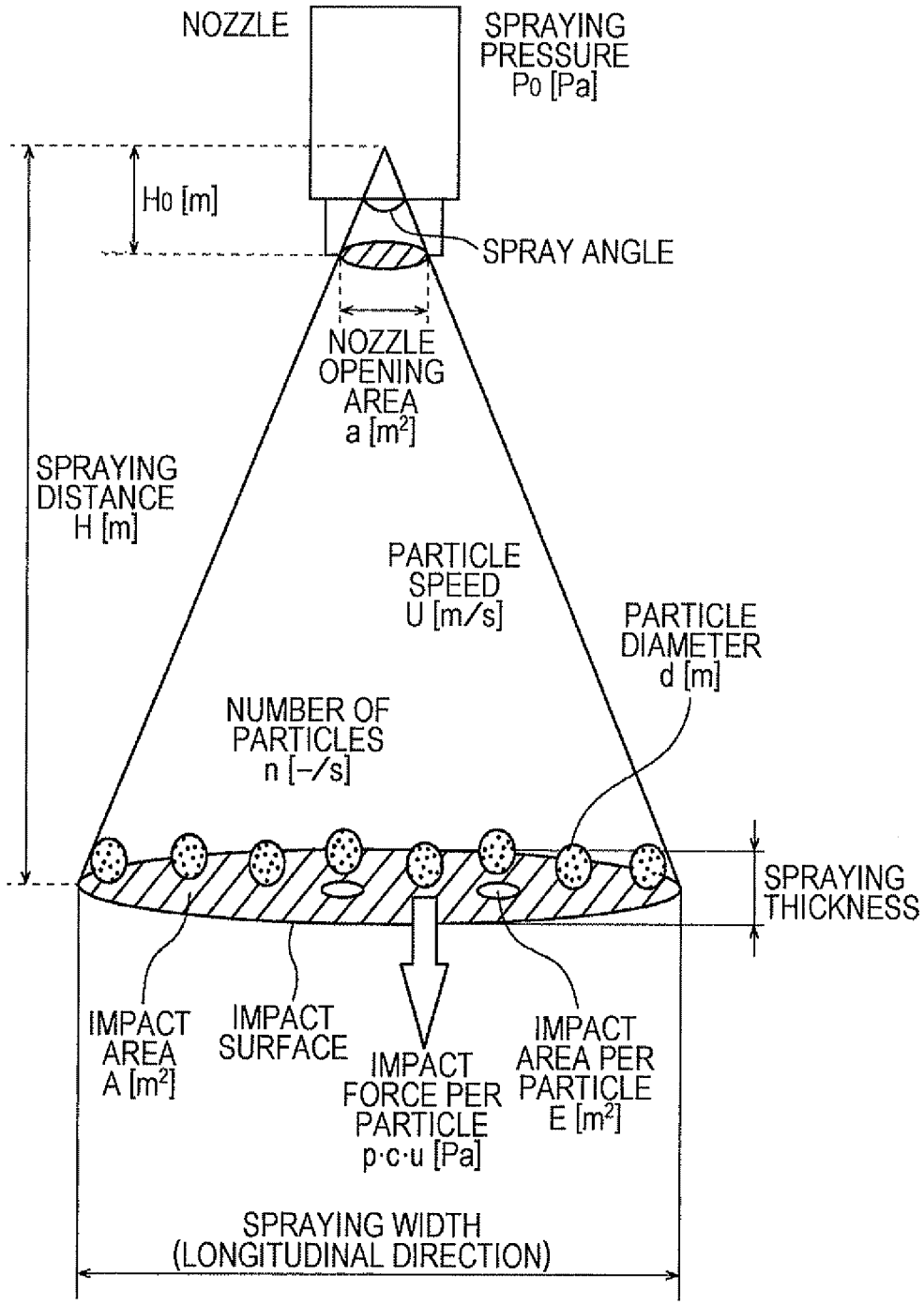
FIG. 8 illustrates an impact model representing the impact of water droplets on a steel sheet when descaling using sprayed water is performed.

That is, descaling performance can be evaluated using a total impact force (F) and a unit impact force (S), which are generated when sprayed water impacts on a surface of a steel material. FIG. 8 illustrates an impact model representing the impact of water droplets on a steel sheet when descaling using sprayed water is performed. The total impact force (F) and the unit impact force (S) in FIG. 8 can be represented by the following equations:

$$F=P0\times a\times C\times(3/d)\times\alpha\times t, \text{ and}$$

$$S=F/A,$$

where F is the total impact force [N] of sprayed water at a surface of a steel sheet, S is the unit impact force [Pa] of sprayed water at the surface of the steel sheet, P0 is the spraying pressure [Pa], a is the orifice area [m2], C is the sonic speed [m/s], d is the droplet diameter of a water droplet [m], α is a coefficient, and t is the time during which a shock wave travels across the droplet [s].

TABLE 1

| Evaluation Indices | | Values for Comparative Example | Values for Invention Example |
|---|---|---|---|
| Descaling Performance (Unit impact Force S) | (1) HSB | 1.50 MPa | 2.25 MPa (1.5 times higher) |
| | (2) RSB | 0.26 MPa | 0.34 MPa (1.3 times higher) |
| | (3) FSB | 0.91 MPa | 1.18 MPa (1.3 times higher) |
| Descaling Flow Rate | (1) HSB | 111 l/min | 111 l/min |
| | (2) RSB | 66 l/min | 39 l/min |
| | (3) FSB | 66 l/min | 39 l/min |
| Electric Power Consumption Rate of Descaling Pump | | 1.0 | 0.7 |
| Index of Fraction Defective due to Descaling Performance | | 1.0 | less than 0.5 |

As shown in this table, in any section of the rolling line, the descaling performance was increased by 1.3 to 1.5 times that of the comparative example, the electric power consumption rate of the pump 30 was 70%, a possible reduction margin of flow rate due to improvement in the descaling performance was 30%, and the fraction defective due to the descaling performance was less than 50% of the comparative example. Therefore, with the descaling nozzle 1, the performance and efficiency in descaling was significantly improved.

Figure 7:
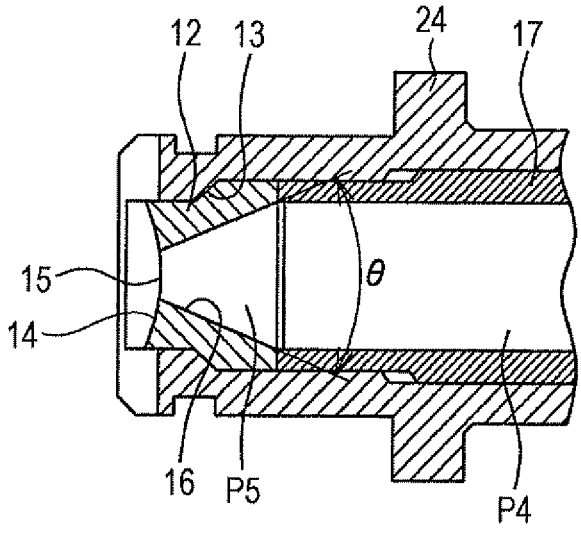
FIG. 7 illustrates a discharge section of an existing descaling nozzle used in a comparative example.
Figure 9:
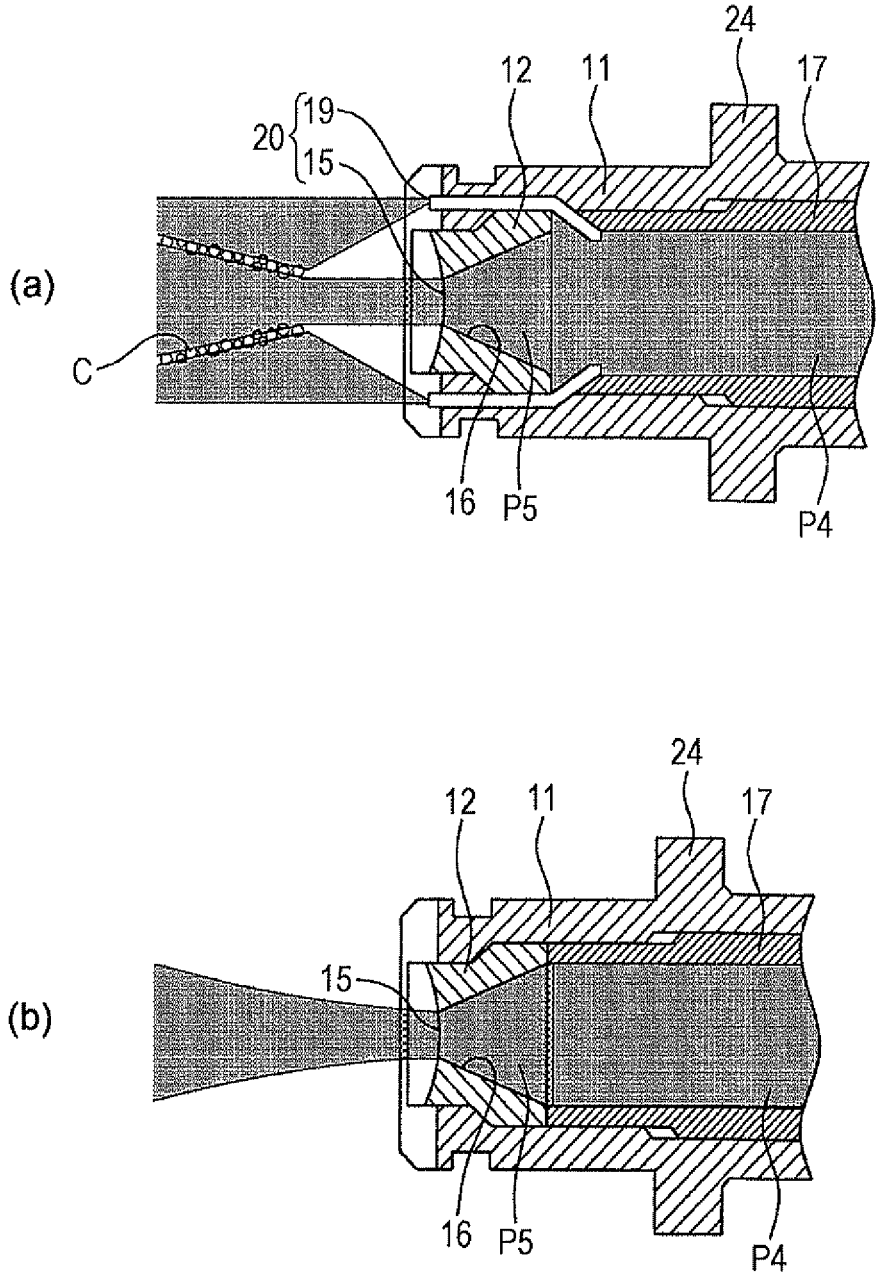
FIG. 9 illustrates a state of a water flow (main flow) jet, FIG. 9(*a*) illustrating an example for the descaling nozzle according to the present invention, and FIG. 9(*b*) illustrating an example for an existing descaling nozzle.

According to the results of a comparative experiment using an existing type (see FIGS. 7 and 9(*b*)), it was confirmed that a sufficient effect can be obtained by adjusting the ratio of the amount of water flow that is introduced into the branch holes 19 to the amount of the entire water flow in the nozzle so as to be in the range of 0% or greater to less than an equal to 50% in accordance with the spraying pressure P0 [Pa], the descaling flow rate [1/min], and the spraying distance H [m].

A descaling nozzle for removing scale from a steel sheet, a descaling apparatus for removing scale from a steel sheet, and descaling method for removing scale from a steel sheet according to the present invention are not limited to the embodiments described above. The embodiments can be modified in various ways within the spirit and scope of the present invention.

REFERENCE SIGNS LIST

1 (descaling) nozzle
2 casing
4 flow regulation unit
11 nozzle case
12 nozzle tip
14 curved groove
15 discharge hole (main flow orifice)
16 taper portion (or conical inclined wall)
17 bushing (or annular side wall)
18 large diameter portion
19 branch hole (branch flow orifice)
20 discharge section
30 pump
40 accumulator
50 heating furnace
60 heating furnace delivery side descaler
61, 62, 63 descaling nozzle attachment adapter
70 rough rolling mill
80 finish rolling mill
K material to be rolled (steel slab)
P1 cylindrical channel
P2 inclined channel
P3 cylindrical channel
P4 cylindrical channel
P5 cylindrical channel
P6 branch channel

The invention claimed is:

1. A descaling nozzle configured to remove scale from a steel sheet by spraying water onto a surface of the steel sheet and using impact of the sprayed water, the descaling nozzle comprising:
- a discharge section at a distal end of the nozzle, the discharge section including a main flow orifice and a branch flow orifice; and
- a large diameter portion that forms a cylindrical channel, wherein:
  - the main flow orifice and the branch flow orifice are each commonly connected to the large diameter portion, and
  - the branch flow orifice is configured to discharge a part of water flow from the large diameter portion so that cavitation occurs at a boundary between the part of water flow discharged from the branch flow orifice and water flow that is discharged from the main flow orifice.

2. The descaling nozzle according to claim 1, wherein the branch flow orifice discharges the water flow so that the water flow discharged from the branch flow orifice surrounds an outer periphery of the water flow that is discharged from the main flow orifice.

3. The descaling nozzle according to claim 2, wherein a ratio of an amount of water flow in the large diameter portion that is introduced into the branch flow orifice to an amount of entire water flow in the large diameter portion is greater than 0% and less than or equal to 50%.

4. The descaling nozzle according to claim 1, wherein a ratio of an amount of water flow in the large diameter portion that is introduced into the branch flow orifice to an amount of entire water flow in the large diameter portion is greater than 0% and less than or equal to 50%.

5. The descaling nozzle according to claim 1, further comprising a taper portion forming a conical channel that abuts a distal end of the cylindrical channel, an inner diameter of the conical channel decreasing toward a distal end of the discharge section.

6. The descaling nozzle according to claim 1, wherein the main flow orifice has an elliptical shape and the branch flow orifice has an arcuate shape.

7. The descaling nozzle according to claim 6, wherein a ratio of a major axis to a minor axis of the elliptical shape is in a range of 1.5 to 1.8.

8. The descaling nozzle according to claim 1, wherein a ratio of an inside diameter of the large diameter portion to a minor axis of the main flow orifice is in a range of 4.5 to 6.9.

9. The descaling nozzle according to claim 1, wherein the main flow orifice and the branch flow orifice are arranged at the end of the nozzle so that a space is formed between the water flows discharged to the surface of the steel sheet from the branch flow orifice and the main flow orifice.

10. A descaling apparatus for removing scale from a steel sheet, the steel sheet being a material that is rolled in a rolling process, the descaling apparatus comprising:
- a plurality of descaling nozzles disposed above and below the steel sheet, wherein:
  - the descaling apparatus removes the scale from a surface of the steel sheet that is to be rolled by spraying high pressure water from the descaling nozzles onto the surface of the steel sheet that is to be rolled, and
  - each of the descaling nozzles includes:
    - a discharge section at a distal end of the nozzle, the discharge section including a main flow orifice and a branch flow orifice; and
    - a large diameter portion that forms a cylindrical channel, wherein:
      - the main flow orifice and the branch flow orifice are each commonly connected to the large diameter portion, and
      - the branch flow orifice is configured to discharge a part of water flow from the large diameter portion so that cavitation occurs at a boundary between the part of water flow discharged from the branch flow orifice and water flow that is discharged from the main flow orifice.

11. The descaling apparatus for removing scale from a steel sheet according to claim 10, wherein the branch flow orifice discharges the water flow so that the water flow discharged from the branch flow orifice surrounds an outer periphery of the water flow that is discharged from the main flow orifice.

12. The descaling apparatus for removing scale from a steel sheet according to claim 10, wherein a ratio of an amount of water flow in the large diameter portion that is introduced into the branch flow orifice to an amount of entire water flow in the large diameter portion is greater than 0% and less than or equal to 50%.

13. The descaling apparatus for removing scale from a steel sheet according to claim 10, wherein:

the branch flow orifice discharges the water flow so that the water flow discharged from the branch flow orifice surrounds an outer periphery of the water flow that is discharged from the main flow orifice, and a ratio of an amount of water flow in the large diameter portion that is introduced into the branch flow orifice to an amount of entire water flow in the large diameter portion is greater than 0% and less than or equal to 50%.

14. A method for removing scale from a steel sheet, the steel sheet being a material to be rolled in a rolling process, the method comprising:

spraying high pressure water from a descaling nozzle onto a surface of the material to be rolled; and removing the scale from the surface of the material to be rolled, wherein:

the descaling nozzle is disposed at each of a plurality of positions above and below the rolling material in the rolling process, and the descaling nozzles includes:

a discharge section at a distal end of the nozzle, the discharge section including a main flow orifice and a branch flow orifice; and a large diameter portion that forms a cylindrical channel, wherein:

the main flow orifice and the branch flow orifice are each commonly connected to the large diameter portion, and the branch flow orifice is configured to discharge a part of water flow from the large diameter portion so that cavitation occurs at a boundary between the part of water flow discharged from the branch flow orifice and water flow that is discharged from the main flow orifice.

15. The method according to claim 14, wherein the branch flow orifice discharges the water flow so that the water flow discharged from the branch flow orifice surrounds an outer periphery of the water flow that is discharged from the main flow orifice.

16. The method according to claim 14, wherein a ratio of an amount of water flow in the large diameter portion that is introduced into the branch flow orifice to an amount of entire water flow in the large diameter portion is greater than 0% and less than or equal to 50%.

17. The method according to claim 14, wherein:

the branch flow orifice discharges the water flow so that the water flow discharged from the branch flow orifice surrounds an outer periphery of the water flow that is discharged from the main flow orifice, and a ratio of an amount of water flow in the large diameter portion that is introduced into the branch flow orifice to an amount of entire water flow in the large diameter portion is greater than 0% and less than or equal to 50%.

* * * * *